United States Patent [19]

Chandler et al.

[11] 4,212,212

[45] Jul. 15, 1980

[54] ROTARY DRIVE APPARATUS

[75] Inventors: Arthur R. Chandler; Victor Moody, both of Lowestoft, England

[73] Assignee: Weatherford/Lamb, Inc., Houston, Tex.

[21] Appl. No.: 949,320

[22] Filed: Oct. 6, 1978

[51] Int. Cl.[2] ..... B25B 17/00

[52] U.S. Cl. ..... 81/57.17; 81/57.2

[58] Field of Search ..... 81/57.15–57.21; 173/163; 175/220; 166/77.5

[56] References Cited

U.S. PATENT DOCUMENTS

| | | | |
|---|---|---|---|
| 1,760,167 | 5/1930 | Palmer | 81/57.17 |
| 1,925,970 | 9/1933 | Pennington | 81/57.17 |
| 2,544,639 | 3/1951 | Calhoun | 81/57.16 |
| 3,774,481 | 11/1973 | Goodman | 81/57.17 |
| 3,875,826 | 4/1975 | Dreyfuss et al. | 81/57.18 |
| 3,892,140 | 7/1975 | Fox et al. | 175/195 |
| 3,906,820 | 9/1975 | Hauk | 81/57.17 |
| 4,084,453 | 4/1978 | Eckel | 81/57.18 |

*Primary Examiner*—James L. Jones, Jr.

*Attorney, Agent, or Firm*—Fulbright & Jaworski

[57] ABSTRACT

An improved rotary drive apparatus for a drill spinner, casing tong, or the like. The apparatus has a drive wheel and idler wheels adapted to drive an endless loop member trained around a cylindrical member to be driven. Pipe engaging rollers are utilized which have freely rotating flanges. The incporation of these freely rotating flanges increases torque output, reduces vibration, reduces wear on the flanges, and reduces likelihood of damage to the cylindrical member to be driven. Reaction rollers are utilized which eliminate or reduce vibration of the cylindrical member during operation of the apparatus and which increase torque output.

2 Claims, 3 Drawing Figures

Fig. 1
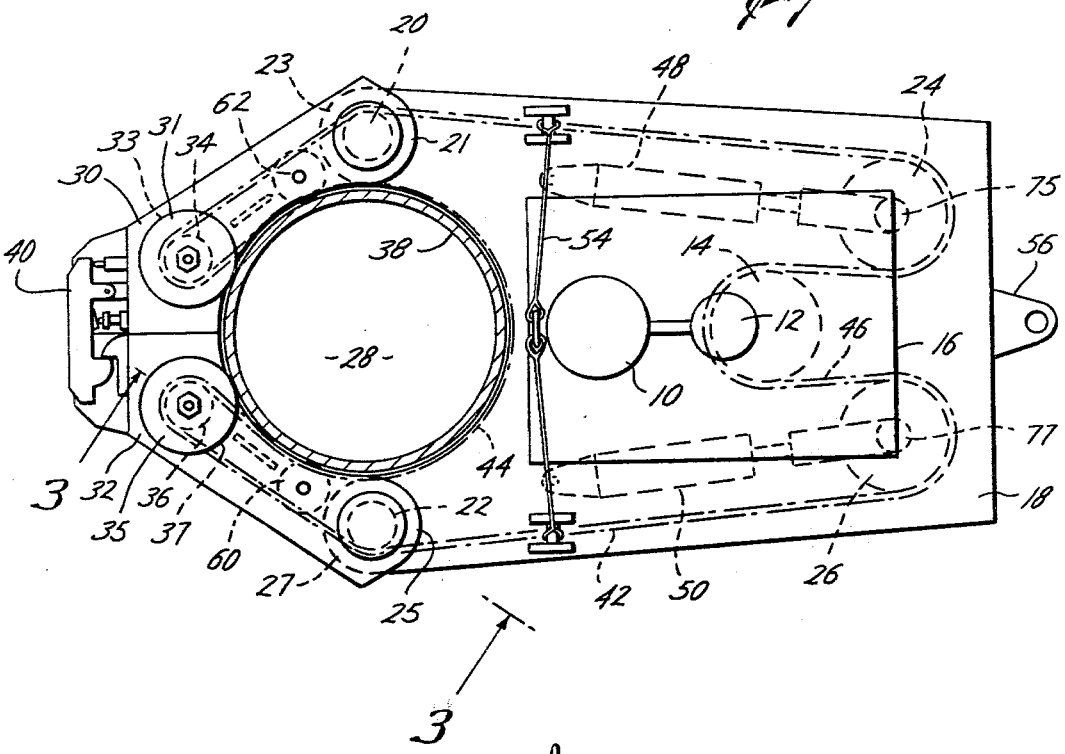
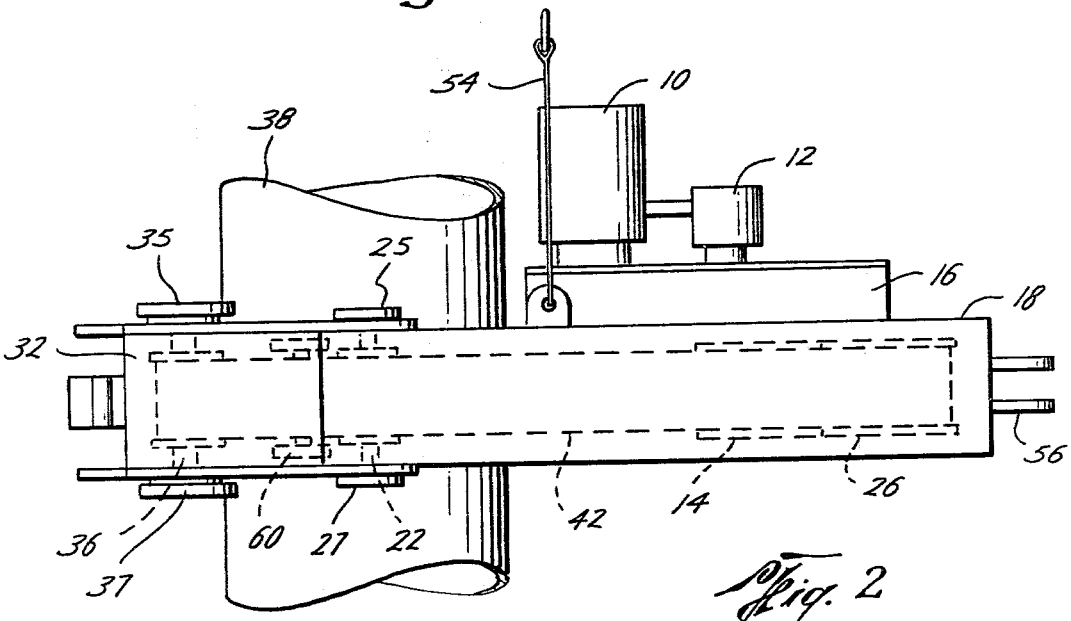
Fig. 2

ROTARY DRIVE APPARATUS

BACKGROUND OF THE INVENTION

1. Field of the Invention

This invention relates to the field of rotary drive apparatus for rotating substantially cylindrical members such as pipe, tubing, and casing.

2. Description of Prior Art

A number of rotary drive devices wherein the cylindrical member is engaged and driven by a combination of chain and friction drive rollers are disclosed in the prior art. The closest prior art of which the applicant is aware is disclosed in two United States patents: U.S. Pat. No. 3,906,820 granted to Earnest D. Hauk on Sept. 23, 1975 and U.S. Pat. No. 3,892,140 granted to Roy K. N. Fox and Rowan W. Patterson on July 1, 1975. Each of these patents include front rollers with fixed, integral flanges.

The use in prior art apparatuses of rollers with integral fixed flanges results in slippage and in wear. The flange surface of a fixed flange travels at a faster speed than the casing surface. This results in slippage of the flange surface on the casing, since the point of contact between the fixed integral flange and the casing does not coincide with the line of the drive chain pin centers—which line is the only position at which common peripheral speeds exist on the casing and roller assemblies. This slippage causes excessive wear on the fixed flanges requiring their periodic, time-consuming, and expensive replacement.

Another problem with the prior art apparatuses is that, under high torque conditions, the cylindrical member to be rotated "topples," i.e., it lifts away from the front rollers and reacts with the opposite inner edge of the apparatus. This leads to substantial friction losses.

SUMMARY OF THE INVENTION

The present invention provides an improved rotary drive apparatus for applying rotational torque to a cylindrical member. One improvement is the incorporation of front rollers having freely rotating flanges. Another improvement is the provision of reaction rollers. These improvements are incorporated into a conventional rotary drive apparatus having a body structure or housing including a recess to receive said cylindrical member, a drive wheel, a plurality of idler wheels, an endless loop trained around the drive wheel and the idler wheels forming a bight in the recess, said body structure including at least one jaw, the jaw bearing at least one of said idler wheels and positioned adjacent said recess, and said jaw being adjacent the recess and pivotable between an open position and a closed position.

In addition to increasing the torque output of the rotary drive apparatus, applicant's improvement of front rollers having freely rotating flanges results in a number of other advantages. For example, vibration during the operation of the device is decreased and the wear on the flanges themselves is decreased. Damage to the surface of the cylindrical member being rotated as a result of slippage of the driven flanges is eliminated or greatly reduced.

It is, therefore, an object of the present invention to provide an improved rotary drive apparatus for applying rotational torque to a cylindrical member through the provision of front rollers having freely rotating flanges.

A further object of the present invention is the provision of such an improved rotary drive apparatus having reaction rollers incorporated into it such that the reaction rollers react against the casing to reduce the friction losses due to toppling of the casing. The incorporation of such reaction rollers produces a significant increase in torque and eliminates or reduces vibration.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 1 is a plan view of a rotary drive apparatus;

FIG. 2 is a side elevation view of the rotary drive apparatus;

DESCRIPTION OF THE PREFERRED EMBODIMENT

Figure 3:
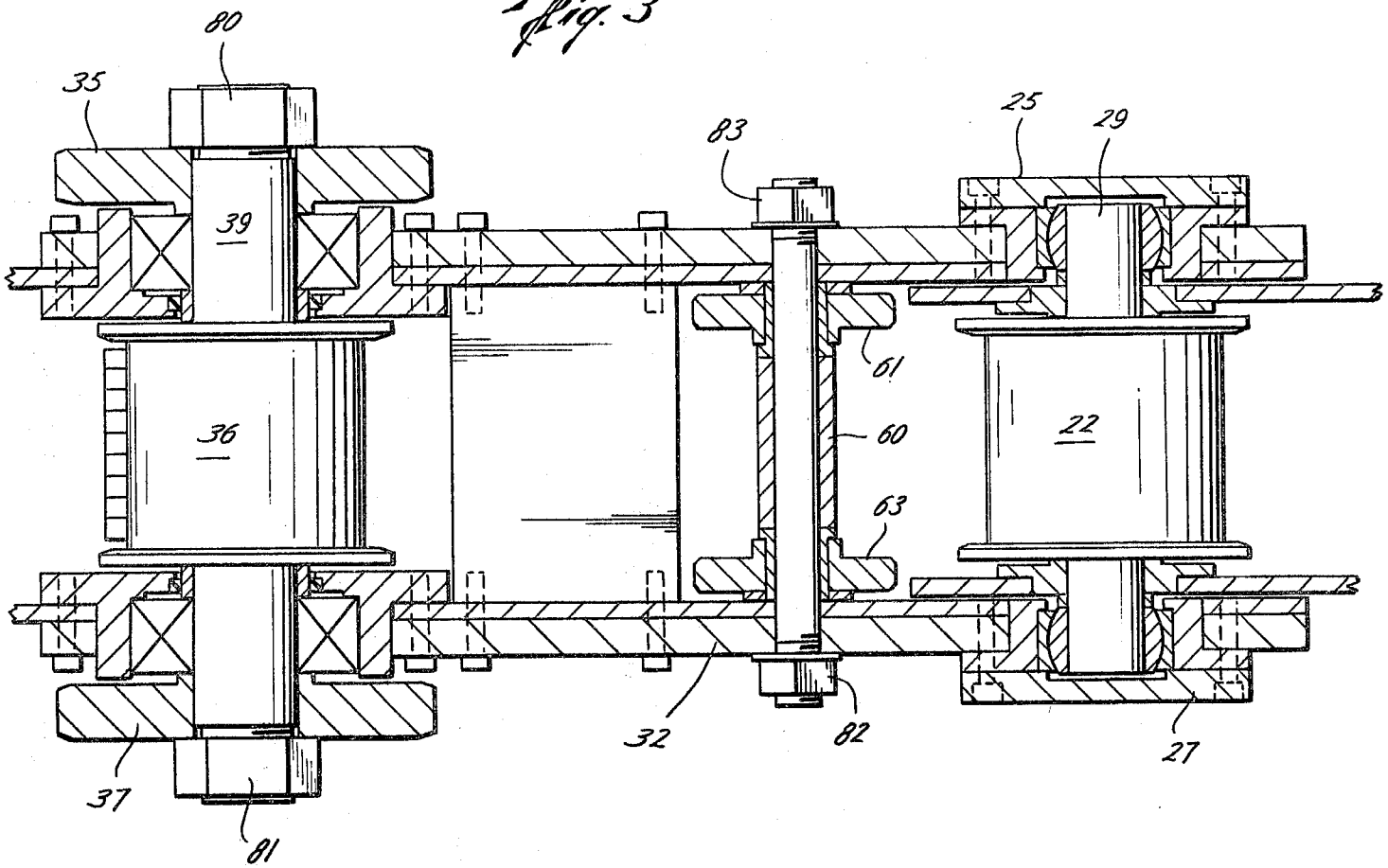
FIG. 3 is a cross-sectional view taken along line 3—3 of FIG. 1.

The present invention will be described as used in a rotary drive apparatus of the type shown in U.S. Pat. No. 3,892,140 for purposes of illustration only as the present invention can be used in other types of rotary drives. Referring now to FIGS. 1 to 3, a casing tong comprises a hydraulic motor 10 controlled by a control valve 12 and driving a sprocket wheel 14 through a gearbox 16. The drive sprocket 14 is mounted in a housing or support 18 which provides a frame supporting the gearbox and motor and also containing idler rollers 20, 22, 24 and 26. Idler rollers 20 and 22 are mounted on opposite sides of a recess 28 in the housing 18. Jaws 30 and 32 are mounted on the housing 18 for pivotal movement about the same axes as the rollers 20 and 22 respectively. The jaws 30 and 32 carry drive rollers 34 and 36 respectively and are pivotable between open positions in which a casing section such as 38 may be inserted in the recess 28 between the separated drive rollers 34 and 36, and closed positions, as shown in the drawings, in which the rollers 34 and 36 are brought adjacent each other. Any suitable latch 40, preferably an automatic latch, is provided for retaining the jaws 30 and 32 in the closed position.

The rollers 24 and 26 are mounted at the opposite end of the casing tong from the recess 28 on opposite sides of the drive sprocket 14 and an endless loop of chain 42 is trained around the idler rollers 20, 22, 24, 26, and around drive rollers 34 and 36, with a re-entrant bight 44 between the drive rollers 34 and 36 extending into the recess 28 for receiving and embracing the casing 38 and with a further re-entrant bight 46 between the rollers 24 and 26 trained round the drive sprocket 14.

The rollers 24 and 26 are mounted on the shafts such as 75 and 77 in the housing 18, the shafts being mounted on pistons of respective hydraulic rams 48 and 50 preferably positioned inside the housing and which are independently controllable by means of control valves (not shown) to displace the rollers 24 and 26 in the housing 18 generally towards and away from the idler rollers 20 and 22 respectively so as to lengthen or shorten the bight 44. Thus, the size of the bight 44 can be adjusted to suit casing diameter. The above description is generally described in U.S. Pat. No. 3,892,140.

Reaction rollers 60 and 62, as shown in FIGS. 1 and 2, are rotatably mounted in the jaws 32 and 30, respectively, and are disposed so that their flanges—flanges 61 and 63 of reaction roller 60, as shown in FIG. 3 and flanges (not shown) of reaction roller 62—contact the outer surface of the cylindrical member to be rotated.

In FIG. 3, front roller 36 is rotatably mounted in jaw 32. Flanges 35 and 37 are freely rotatable and mounted around shaft 39 of front roller 36 and are secured, respectively, by nuts 80 and 81. Reaction roller 60 having fixed flanges 61 and 63 is rotatably mounted within jaw 32 and secured by nuts 82 and 83. Idler roller 22 is located in jaw 32 at a point coincident with the point at which jaw 32 is pivotally mounted on the housing 18. Front roller 34 (FIG. 1) mounted in jaw 30 is of the same construction as front roller 36. Front roller 34 has flanges 31 and 33 freely rotatable and mounted to a shaft (not shown) like shaft 39 of front roller 36. Reaction roller 62, mounted in jaw 30 between front roller 31 and idler roller 20, is of a construction the same as reaction roller 60. Idler roller 20 is located in jaw 30 at a point coincident with the point at which jaw 30 is pivotally mounted on the housing 18.

In operation, to apply to a casing, the casing tong is lifted by a hanger 54 attached to the housing 18, the jaws 30 and 32 are opened and the bight 44 is applied around the casing 38 (having previously been set to a sufficiently large size by controlling the rams 48 and 50) and the jaws 30 and 32 are then closed and locked closed by the latch 40. A back-up guy is then attached to a clevis 56 secured to the housing adjacent the rollers 24 and 26 to provide a bearing for the casing tong. If the casing 38 is to be rotated clockwise (as seen in FIG. 1) the ram 50 is extended to take up slack in the chain and is then locked in position by closing its control valves. Pressure is then applied to the ram 48 to apply tension to the chain 42 and the hydraulic motor 10 started. Conversely, for anticlockwise rotation, the ram 48 is first extended and then locked in position before tension is applied by applying pressure to the ram 50. This mode of operation ensures that the ram 48 or 50 bearing the pull of the drive sprocket 14 on the chain 42 is locked in position, while the other ram is in the relatively slack return portion of the chain, thus reducing the pressure requirements for the hydraulic supply to the rams 48 and 50.

It is found that a sufficient grip can be obtained on the casing 38 by the chain 42 engaging the casing directly and it will be appreciated that the casing tong is exceptionally simple to install and operate.

In operation, flanges 35 and 37 of front roller 36 and flanges 31 and 33 of front roller 34 all rotate freely, thereby eliminating the slippage, wear, and friction loss which result if fixed integral flanges are employed. Since the flange surfaces of freely rotating flanges do not travel at a speed faster than the speed of the casing surface, slippage is eliminated and torque is increased. In actual comparative tests, increases of 3250, 3650 and 5050 foot pounds of torque were achieved by using freely rotating flanges as compared to tests using fixed flanges on the front drive rollers. Reaction rollers 60 and 62 react against the outer surface of the cylindrical member being rotated, thereby reducing the effects of the "toppling" of the casing, should toppling occur, and preventing the casing from contacting the inner edges of the jaws 30 and 32 or the inner edges of the housing 18. These reaction rollers 60 and 62 also produce an increase in torque output. In actual comparative tests, increases of 600, 2000, and 2400 foot pounds of torque were achieved by the addition of reaction rollers to a typical rotary drive apparatus.

The present invention, therefore, is well adapted to carry out the objects and attain the ends and advantages mentioned as well as those inherent therein. While a presently preferred embodiment of the invention has been given for the purpose of disclosure, numerous changes in the details of construction and arrangement of parts can be made which will readily suggest themselves to those skilled in the art and which are encompassed within the spirit of the invention and the scope of the appended claims.

What is claimed is:

1. In a rotary drive apparatus for applying rotational torque to a cylindrical member of the type having a body structure including a recess to receive the cylindrical member, a plurality of wheels mounted to said body structure, an endless loop trained round said wheels and disposed so that it contacts the outer surface of the cylindrical member when the cylindrical member is positioned in the recess, a drive means mounted to the body structure for driving the endless loop, two jaws for closing off the recess during operation, at least one of said jaws rotatably mounted to the body structure, one of said wheels rotatably mounted on the front of each jaw, each of said front mounted wheels having freely rotating flanges disposed so that they contact and support the outer surface of the cylindrical member during operation and the outer periphery of said flanges rotates at the same speed as the outer periphery of said member, the improvement which comprises two reaction rollers engaging said cylindrical member when the member is positioned in the recess, each jaw having one reaction roller mounted thereon, said reaction rollers disposed so that both of the wheels with freely rotating flanges are positioned between the reaction rollers and so that the reaction rollers contact the cylindrical member thereby reducing the effects of toppling of the cylindrical member should toppling occur.

2. An improved rotary drive apparatus, for applying rotational torque to a cylindrical member, of the type having a body structure including a recess to receive said cylindrical member, a drive wheel journalled on said body structure, a plurality of idler wheels journalled on said body structure, an endless loop trained round said drive wheel and around said idler wheels and adapted to form a re-entrant bight in said recess, said body structure including two jaws bearing at least one of said idler wheels and positioned adjacent said recess, each of said jaws being pivotable between an open position in which said recess is open for insertion and removal of said cylindrical member from said bight and a closed position in which said bight is clasped about said cylindrical member, means for retaining said jaws in said closed position, roller means mounted on the outer end of each of said jaws, each roller means having freely rotating flanges, said endless loop being connected to said roller and said roller means serves as a support element for aiding said endless loop in rotating said cylindrical member, said freely rotating flanges disposed so that they contact and support the cylindrical member to be rotated, the improvement which comprises: a reaction roller mounted on each of said jaws between a drive wheel and an idler wheel for preventing said cylindrical member from engaging said jaws, said reaction rollers disposed so that both roller means mounted on the outer end of each jaw are positioned between the reaction rollers.

* * * * *